United States Patent [19]

Vignoli

[11] Patent Number: 4,830,625

[45] Date of Patent: May 16, 1989

[54] ELECTRICAL CONNECTOR

[75] Inventor: Guido Vignoli, Alta, Italy

[73] Assignee: AMP Incorporated, Harrisburg, Pa.

[21] Appl. No.: 189,909

[22] PCT Filed: Aug. 13, 1987

[86] PCT No.: PCT/US87/01965

§ 371 Date: Apr. 6, 1988

§ 102(e) Date: Apr. 6, 1988

[87] PCT Pub. No.: WO88/01796

PCT Pub. Date: Mar. 10, 1988

[30] Foreign Application Priority Data

Aug. 26, 1986 [GB] United Kingdom ..... 8620634

[51] Int. Cl.[4] ..... H01R 4/24

[52] U.S. Cl. ..... 439/404; 439/417; 439/717

[58] Field of Search ..... 439/715–719, 439/389–419, 466, 468, 473, 694, 749

[56] References Cited

U.S. PATENT DOCUMENTS

| | | | |
|---|---|---|---|
| 3,275,972 | 9/1966 | Eisert | 439/716 |
| 3,753,216 | 8/1973 | Johnson et al. | 439/718 |
| 3,824,530 | 7/1974 | Roberts et al. . | |
| 3,970,354 | 7/1976 | Hopkins et al. . | |
| 4,053,197 | 10/1977 | Teagno . | |
| 4,140,360 | 2/1979 | Huber . | |
| 4,212,507 | 7/1980 | Bunnell . | |
| 4,317,608 | 3/1982 | Dechelette . | |
| 4,634,209 | 1/1987 | Forberg et al. | 439/719 |
| 4,753,606 | 6/1988 | DeLuca et al. | 439/719 |
| 4,753,610 | 6/1988 | Eason et al. . | |

*Primary Examiner*—David Pirlot

*Attorney, Agent, or Firm*—William B. Noll

[57] ABSTRACT

A connector comprises a housing body (1) receiving a contact member (6) having a conductor receiving end (7) formed with wire connecting slots (12) into which a wire (46) is stuffed by an insulating cover member (2). The exit end of the wire (46) is secured bent through ninety degrees by arms (34) extending from the housing body (1) which are also used to link releasably adjacent connectors together to form a connector strip by receipt of projections (35) on the ends of the arms (34) in eyes (40).

4 Claims, 6 Drawing Sheets

ELECTRICAL CONNECTOR

BACKGROUND OF THE INVENTION

The invention relates to an electrical connector of the type in which a conductor can be terminated by forcible insertion transversely of its axis along a conductor receiving slot of a contact member mounted in a cavity in an insulating housing body adjacent one end and retained in the slot by engagement with a cover member movable into latching engagement with the housing body to engage the conductor thereby to retain the conductor in the slot.

In connectors of this type, the cover member is provided with latching projections engageable in eyes formed in the housing body adjacent a cover member receiving end to latch the cover member to the housing body.

Such connectors have become increasingly widely used, particularly in the automotive and domestic appliance industries as they are well adapted for assembly by automated, mass production, techniques and yet ensure a very reliable, insulated, electrical connection to the conductor for use in adverse environments subject to vibration.

In some applications it is necessary for the conductor to be retained bent through a right angle to extend in the direction of the slot axis as it exits from a first side of the housing body, as described in French Patent No. 8000301. In that prior proposal, the cover member is formed with a conductor receiving channel formed with inwardly directed projections which secure the exiting portion of conductor in the channel thereby retaining the conductor in bent condition.

However, disadvantages of using the cover to retain the conductor in bent condition are that the considerable stress imposed on the cover, which is a relatively small plastic part, increases the distortion of the cover with risk of unlatching from the housing body or reduction in the force retaining the conductor in the slot, reducing the electrical reliability.

In addition, it is desirable to latch releasably adjacent connector bodies together to form a strip of connectors which can be fed automatically to conductor terminating apparatus and, preferably, stored on reels.

One proposal for releasably latching the adjacent connector bodies together to form a strip is described in German Utility Model No. G8529292.3 where interengageable hook-form latches are provided on the opposite side walls of the connector bodies at locations remote from the cover member receiving ends of the connector bodies. However, such latches must be specifically designed to interengage with a degree of play sufficient to enable reeling of the connector strip about an axis which extends perpendicularly to the axis of the contact slots and housing cavities.

SUMMARY OF THE INVENTION

According to the invention, the housing body is formed with a pair of latching arms with inwardly directed projections at their ends, which arms extend in mutually opposed, spaced, relation transversely of the cavity axis, from the first side of the housing body at the cover member receiving end and are receivable in the respective eyes of an adjacent housing body releasably to latch the housing bodies together, prior to termination of a conductor therein, and define between them a conductor receiving channel with the projections securing an exiting portion of a conductor in the channel bent through a right angle to extent in the direction of the slot axis, after the conductor has been terminated in the contact slot by the movement of the cover member into latching engagement with the housing body.

As a result of the conductor being secured in bent condition by the latching arms on the housing body, a larger radius of curvature at the bent can be accommodated and relatively little or no stress is imposed on the cover, obviating the risk of distortion, dislodgement, and consequential deterioration of the electrical connector. In addition, the requirement for separate connector latching arms and conductor securing members is avoided, reducing the complexity of moulding. As the latching arms are located at the cover member receiving end of the connector body, a slight degree of flexure of the latching arms or play in their engagement with the eyes will permit adjacent housing bodies to tilt relative to each other with reduction of the separation of the other ends, as illustrated in the above-mentioned utility model which will enable a connector strip assembled from a series of linked housings to be readily flexed into arcuate form for storage on a reel.

An example of an electrical connector according to the invention will now be described with reference to the accompanying drawings.

DETAILED DESCRIPTION OF THE PREFERRED EMBODIMENT

Figure 1B:
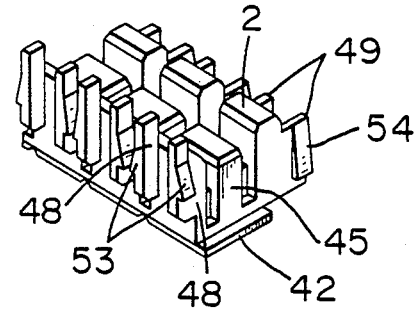
FIG. 1B is a fragmentary perspective view of an underside of the cover member.
Figure 1A:
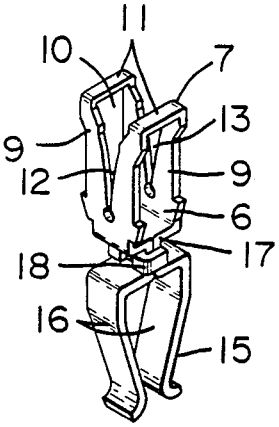
FIG. 1A is a perspective view of a first side of the connector with a terminal exploded therefrom and the cover member integrally joined to the housing body.
Figure 1A:
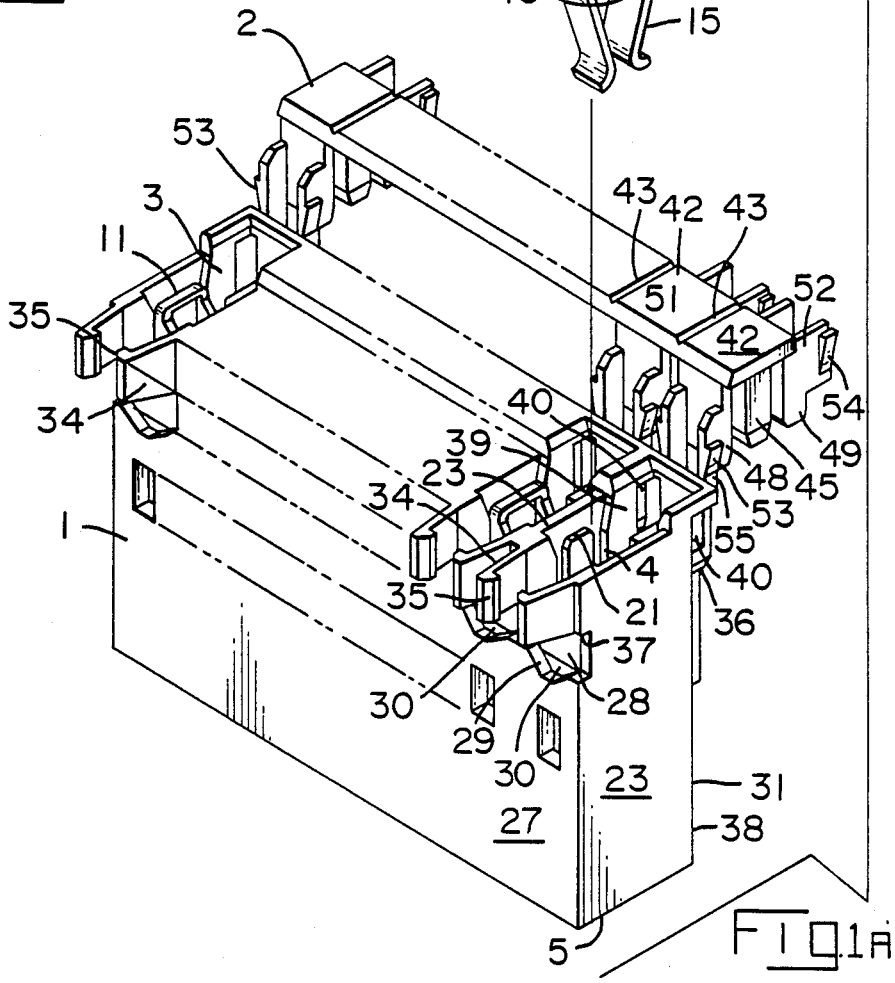
Figure 2A:
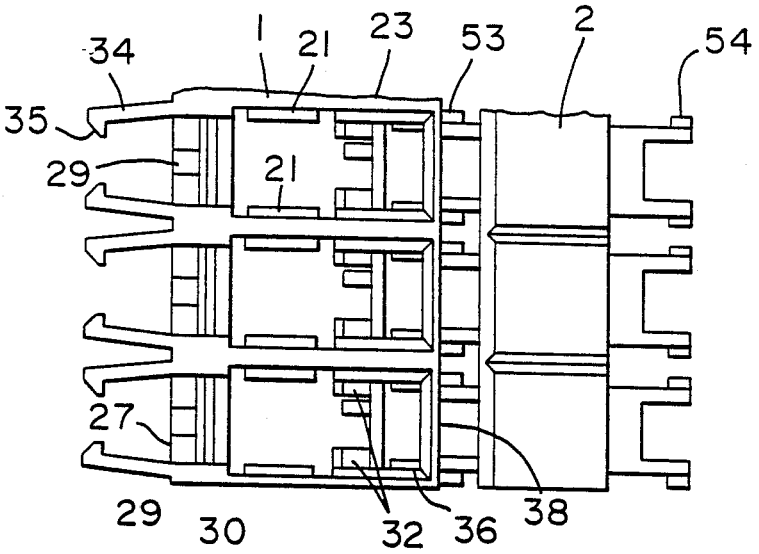
FIG. 2A is a fragmentary plan view of the connector housing.
Figure 2B:
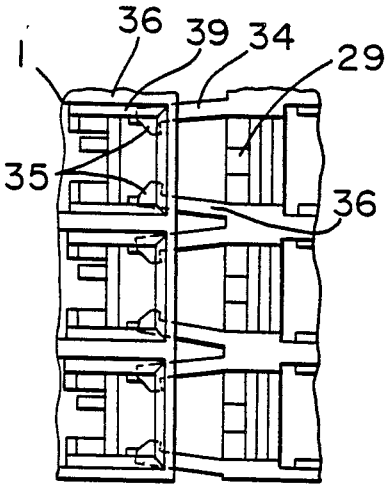
FIG. 2B is a fragmentary plan view of adjacent housing bodies linked together for forming a strip.

The connector comprises a housing body 1 and cover member 2 moulded in one piece of plastics material. The housing body 1 is formed with a row of elongate cavities 3 opening to opposite cover member receiving and mating ends 4 and 5 respective of the housing body and each receiving a contact member 6 of generally known form.

Each contact member 6 is stamped and formed in one piece from sheet metal strip and comprises a conductor connecting end 7 constituted by a pair of interconnected parallel plates 9 joined by a pair of transverse straps 11 to define a wire receiving mouth 10 converging to a pair of aligned wire receiving slots 12 and 13 in respective plates; and a tab or board receiving end 15 constituted by a pair of limbs 16 extending in opposed relation from an intermediate, waisted, portion 17 at which ears 18 extending from one strip portion are clinched around an opposite strip portion to secure the plates 9 and limbs 16 together. When a contact member 6 is inserted into a cavity 3, the straps 11 engage shoulders 21 formed on opposed end walls 23 of the cavities thereby preventing further movement into the cvity and providing support for the contact during wire insertion, as described in UK Patent No. 1584909.

Figure 3:
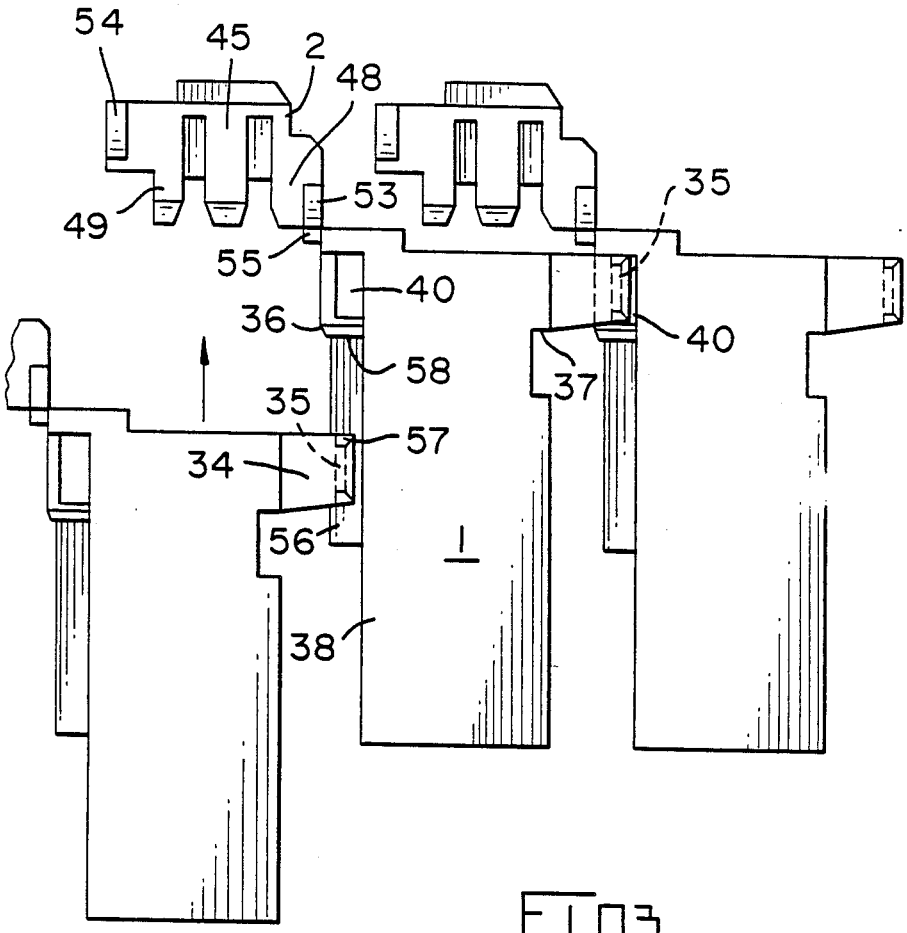
FIG. 3 is a side elevation of the connectors illustrating the manner in which they are linked together to form a strip.
Figure 4:
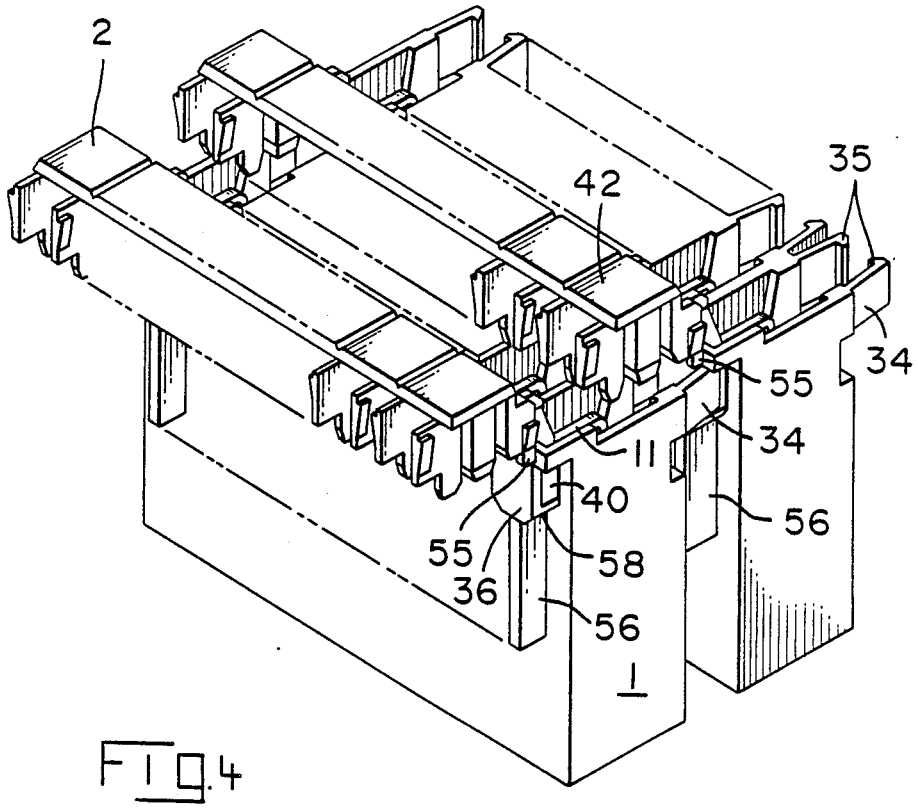
FIG. 4 is a perspective view of a pair of connectors linked together for forming a strip.
Figure 5:
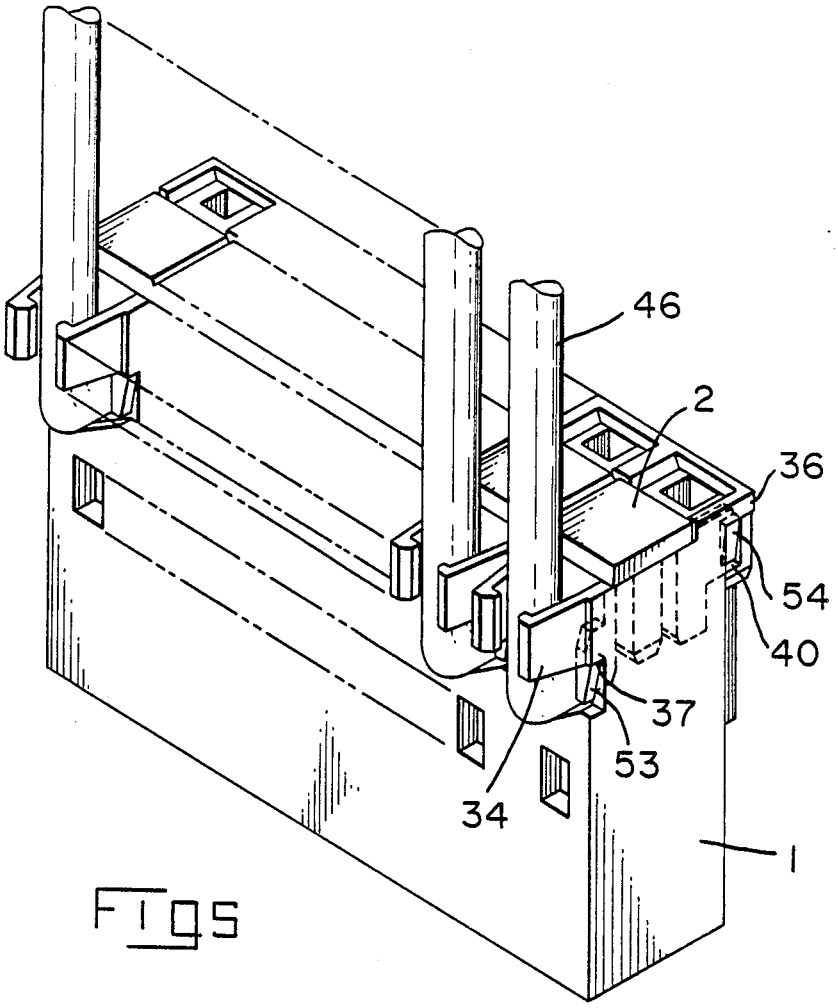
FIG. 5 is a perspective view of a connector terminating a series of conductors; and, FIG. 6 is a cross-sectional view of the connector shown in FIG. 5.

The mating end 5 of the housing body 1 is formed with a printed circuit board receiving slot 222 aligned with respective board receiving ends 15 of the respective contact members 6, and a projection 25 is frmed on one edge of the slot for engagement in an aperture in a printed circuit board to retain the connector on the board. A first side wall 27 of the housing body is rebated from the cover receiving end to provide a wire exit aperture 28, the upper edge 29 of the wall being recessed to cradle the conductor and having a wire gripping tooth 30. Side wall 31, opposite the first side wall 27, is formed with a pair of spaced-apart wire supporting shoulders 32 aligned with the edge 29. A row of pairs of latching arms 34 having inwardly directed projections 35 at their ends extend in mutually opposed, spaced relation transversely of each housing cavity axis from the first side wall at the cover member receiving end 4 of the housing body 1. A pair of cover member latching shoulders 37 are defined by rebates formed immediately below the latching arms 34. A cover member receiving pocket 36 extends in the opposite direction form a second, opposite, side wall 38 at the cover member receiving end 4 of the housing body 1 and is formed in opposite end walls 39 with a pair of opposed latching eyes 40 aligned to receive the projections 35 of another housing body 1 located in side-by-side relation (as shown in FIGS. 3 and 4).

The cover member 2 comprises a row of segments 42 interconnected by webs 43. Each segment 42 is shaped for receipt in the cavity 3 in the cover member receiving end 4, with the webs 43 when overlying the end walls 23 between adjacent cavities. Each segment 42 of the cover member 2 includes a central head 45 shaped to be received between the plates 9 and straps 11 of a contact member 6 when the cover member 2 is applied to the housing body 1, thereby to serve as a stuffer member for a conductor 46 to be connected to the contact member 6, as will be described below.

Figure 6:
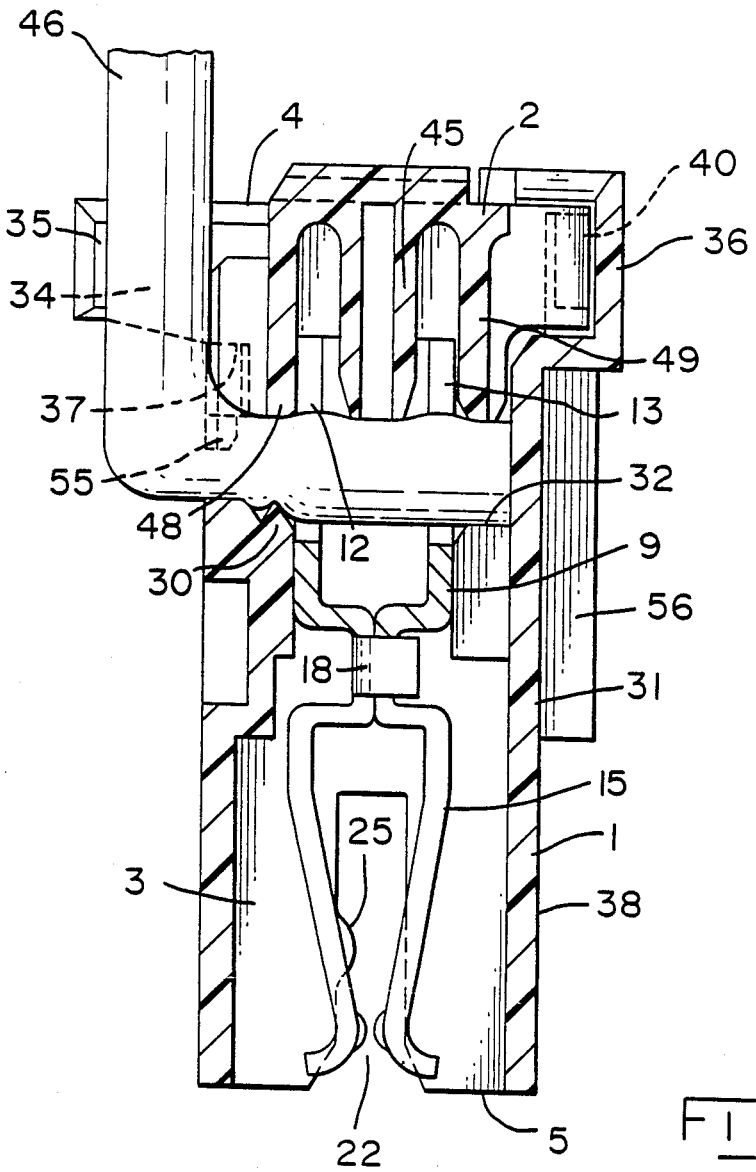

On either side of the land 45 there are further lands 48 and 49 each shaped to be received in the housing body 1, such adjacent lands 45 and 48, and 45 and 49, embrace end portions of the two plates 9 of the contact member 6 respectively, as shown in FIG. 6.

First and second pairs of cover latching limbs 51 and 52 having outwardly directed cover latching ramps 53 and 54, respectively, extend in mutually spaced parallel relation from lands 48 and 49, the limbs 51 being integrally joined to a back wall of the pocket 36 by vertical extensions 55.

As shown in FIGS. 3 and 4, adjacent housing bodies 1 can be releasably linked together to form a strip by relative movement in the direction indicated by the arrow with the latching arms 34 receiving between them a guide rib 56 formed on the second side wall of the housing body 1 until the projections 35 are received in the latching eyes 40 in the pocket with a snap action. Both the projections 35 and corners of the pocket 36 adjacent a base wall are formed with chamfers 57 and inclined guiding surfaces 58 to facilitate the linking.

To enable conductor termination, successive housing bodies 1 may be released from the strip by movement in the opposite direction and the cover member 2 sheared from its housing body 1 in known fashion.

An end of an insulated chamber is then inserted into the cover receiving end 4 of the housing body 1 between the straps 11 in the mouth 10 of the contact member 6 and the cover member 2 forced into the cavity 3 at the cover receiving end 4 so that the lands force the conductor along the slots 12 and 13 with the slot edges contacting the conductor core until the latching ramps 53 and 54 snap under the shoulders 37 into the eyes 40, thereby securely latching the cover member 2 to the housing body 1. During such movement, the extensions 55 may engage the recessed edge 29 of the side wall 27 tending to curl around the conductor.

Subsequent to the termination described above, the exit portion of the conductor 46 is bent through a right angle into the embrace of the latching arms 34 to extend in the direction of the slot and cavity axes and secured in such position by engagement with the projections 35.

I claim:

1. An electrical connector of the type in which a conductor (46) can be terminated by forcible insertion transversely of its axis along a conductor receiving slot (12) of a contact member (6) mounted in a cavity (3) in an insulating housing body (1) adjacent one end of said housing body and retained in the slot by engagement with a cover member (2) movable into latching engagement with the housing body to engage the conductor (46) thereby to retain the conductor (46) in the slot (12), the cover member (2) being provided with latching projections (54) engageable in eyes (40) formed in the housing body (1) adjacent a cover member receiving end to latch the cover member (2) to the housing body (1), characterised in that the housing body (1) is formed with a pair of latching arms (34) with inwardly directed projections (35) at their ends, which arms (34) extend in mutually opposed, spaced relation transversely of a cavity axis, from a first side of the housing body (1) at the cover member receiving end and are receivable in the respective eyes (40) of an adjacent housing body (1) releasably to latch the housing bodies (1) together, prior to termination of a conductor (46) therein, and define between them a conductor receiving channel with the projections (35) securing an exiting portion of a conductor (46) in the channel bent through a right angle to extend in the direction of the slot axis, after the conductor (46) has been terminated in the contact member slot (12) by the movement of the cover member (2) into latching engagement with the housing body (1).

2. An electrical connector according to claim 1, wherein a mating end (5) of the housing body (1) is formed with a printed circuit board receiving slot (22) and the contact member (6) includes a board receiving end (15) comprising a pair of contact limbs (16) extending in opposed relation from a waisted portion (17) at which the limbs (16) are calcined together adjacent free ends aligned with the board receiving slot (22).

3. An electrical connector according to claim 1 or 1, wherein a first side wall (27) of the housing body is rebated from the cover receiving end to provide a wire exit aperture (28), an upper edge (29) of the wall being recessed to cradle the conductor and having a wire gripping tooth (30).

4. An electrical connector according to claim 3, wherein a side wall (31) opposite the first side wall (27) is formed with a pair of spaced-apart wire supporting shoulders (32) aligned with the edge (29).

* * * * *